United States Patent [19]

Brice et al.

[11] Patent Number: 4,465,697

[45] Date of Patent: Aug. 14, 1984

[54] COFFEE BREWING APPARATUS AND METHOD

[75] Inventors: Michael F. Brice, Syosset; Gaetano A. Natoli, Suffolk, both of N.Y.

[73] Assignee: Brice Ilotan Research Corporation, Ronkonkoma, N.Y.

[21] Appl. No.: 504,155

[22] Filed: Jun. 14, 1983

[51] Int. Cl.[3] ..... A23F 5/26; B65B 29/02

[52] U.S. Cl. ..... 426/79; 99/287; 99/295; 99/316; 99/321; 426/80; 426/82; 426/77; 426/433; 206/0.5

[58] Field of Search ..... 426/77-84; 99/287, 295, 316, 321, 322, 323; 210/218; 206/0.5

[56] References Cited

U.S. PATENT DOCUMENTS

| | | | |
|---|---|---|---|
| T973,014 | 8/1978 | Rambold | 426/83 |
| 214,617 | 4/1879 | Brown . | |
| 234,556 | 11/1880 | Fitzgerald, Jr. | 99/320 |
| 240,402 | 4/1881 | Gee | 99/322 |
| 352,516 | 11/1886 | Burden et al. . | |
| 382,870 | 5/1888 | Farrington | 99/323 |
| 453,972 | 9/1891 | Gray . | |
| 569,678 | 10/1896 | Stephens et al. | 99/323 |
| 739,470 | 9/1903 | Wegner . | |
| 790,626 | 5/1905 | French | 99/298 |
| 806,595 | 12/1905 | Steck | 99/317 |
| 829,652 | 8/1906 | Johnson . | |
| 880,190 | 2/1908 | Von Bültzingslöwen . | |
| 916,327 | 3/1909 | Kingsbury | 99/290 |
| 994,975 | 6/1911 | Calkin et al. | 426/433 |
| 1,367,568 | 2/1921 | Smith . | |
| 1,489,806 | 4/1924 | Anderson | 426/77 |
| 1,601,613 | 9/1926 | Fenyves . | |
| 1,648,906 | 11/1927 | Lubrano . | |
| 2,092,510 | 9/1937 | Haut | 426/82 |
| 2,123,054 | 7/1938 | Lamb et al. | 426/80 |
| 2,137,243 | 11/1938 | Heyman | 426/77 |
| 2,147,831 | 2/1939 | Doble | 426/81 |
| 2,157,656 | 5/1939 | Doble | 426/81 |
| 2,187,417 | 1/1940 | Doble | 426/83 |
| 2,260,858 | 10/1941 | Naef | 426/82 |
| 2,291,060 | 7/1942 | Schiess | 99/323 |
| 2,291,278 | 7/1942 | Cleaves . | |
| 2,570,521 | 10/1951 | Chester . | |
| 2,743,664 | 5/1956 | Dale | 99/306 |
| 3,102,465 | 9/1963 | Montesano | 99/323 |
| 3,154,418 | 10/1964 | Lovell et al. | 426/78 |
| 3,193,388 | 7/1965 | Conrey | 406/77 |
| 3,252,803 | 5/1966 | Belasco | 426/86 |
| 3,257,212 | 6/1966 | Kasket . | |
| 3,342,518 | 9/1967 | Gorton, Jr. | 426/82 |
| 3,345,935 | 10/1967 | Waline | 99/304 |
| 3,347,151 | 10/1967 | Ronalds | 99/295 |
| 3,354,812 | 11/1967 | Gorton, Jr. | 99/323 |
| 3,428,460 | 2/1969 | Ely | 426/86 |
| 3,607,302 | 9/1971 | Beck | 99/295 |
| 3,692,536 | 9/1972 | Fant | 426/79 |
| 3,755,895 | 9/1973 | Claasen | 426/82 |
| 3,833,740 | 9/1974 | Schmidt | 426/77 |
| 3,879,565 | 4/1975 | Einstman et al. | 426/302 |
| 3,895,118 | 7/1975 | Rambold | 426/80 |
| 3,899,599 | 8/1975 | Rambold | 426/82 |
| 3,935,318 | 1/1976 | Mihailide | 406/80 |
| 3,946,652 | 3/1976 | Gorin | 99/323 |
| 4,141,997 | 2/1979 | Syroha et al | 426/79 |
| 4,167,899 | 9/1979 | McCormick | 99/302 |
| 4,215,628 | 8/1980 | Dodd, Jr | 99/323 |
| 4,229,481 | 10/1980 | Fornari | 426/77 |
| 4,306,492 | 12/1981 | Zimmerman | 426/80 |
| 4,338,338 | 7/1982 | Popkes | 426/82 |
| 4,410,550 | 10/1983 | Gashill | 426/80 |

FOREIGN PATENT DOCUMENTS

| | | | |
|---|---|---|---|
| 236761 | 5/1961 | Austria | 426/425 |
| 2323052 | 11/1974 | Fed. Rep. of Germany | 426/77 |
| 1601335 | 10/1981 | United Kingdom | 426/77 |

*Primary Examiner*—Steven L. Weinstein

*Attorney, Agent, or Firm*—Antonelli, Terry & Wands

[57] ABSTRACT

A coffee brewing device includes a housing for holding ground coffee with at least one wall of the housing being formed from a permeable filtering membrane which permits a flow-through of water. The interior of the housing is vented to the atmosphere through an attached conduit, which can be used as a handle, so as to permit the escape of gases which are generated when the coffee grounds are submerged in a cup of hot water. Baffles which serve to control the extent and direction of gas movement may be positioned in the housing. By such control, the generated gases may be utilized to agitate the coffee grounds to thus get a more complete mixing of the grounds with the water prior to a venting of the gases to the atmosphere. The baffles may be of both a perforated and non-perforated design so as to control gas bubble size and direction of flow.

21 Claims, 14 Drawing Figures

COFFEE BREWING APPARATUS AND METHOD

BACKGROUND OF THE INVENTION

1. Description of the Invention

The present invention relates to the brewing of coffee and more particularly pertains to new and improved coffee brewing methods and apparatuses which permit the rapid brewing of ground coffee, one cup at a time, without the necessity of utilizing expensive and cumbersome coffee percolators and the like.

2. Description of the Prior Art

At the outset, it is to be understood that the terminology "ground coffee" and variations thereof, e.g., "coffee grounds," is illustrative in scope and includes all forms of coffee utilizable in an extraction brewing process, as opposed to completely soluble forms of coffee such as commercially available and commonly labeled "instant coffee." Accordingly, the terminology "ground coffee" may include pulverized coffee, chopped coffee, insoluble dried coffee, etc., and may in some cases, even include whole coffee beans.

As can be appreciated, coffee is one of the more popular beverages consumed in the United States, as well as in many other countries around the world. As is well known in the art, coffee is normally brewed from ground coffee beans and the quality of the brewed coffee is dependent upon several factors. In this respect, the most desirable quality is obtained when the coffee is brewed directly from roasted ground coffee beans. Inasmuch as freshly-ground coffee will become substantially stale in approximately seven days, manufacturers have resorted to packaging the freshly-roasted ground coffee in vacuum-sealed containers and in this manner, the ground coffee will remain reasonably fresh for a peiod of about five to six months. However, once the vacuum seal of a particular container has been broken, the quality of the coffee will begin to deteriorate whereby staleness will be evident in about seven or less days.

While ground coffee is the most desirable form of coffee to brew, inasmuch as it has the most distinct aroma and flavor characteristics, considerable difficulty is normally experienced in effecting such brewing. For example, virtually all currently-known methods of brewing ground coffee involve the use of cumbersome and expensive equipment which is slow in operation, which normally requires the brewing of substantially more coffee than is needed, and which is then difficult to clean and store. Further, it should be noted that coffee beans are composed of about 300 different chemicals, many of which enter into solution in a brewed coffee mixture. More particularly, soluble coffee solids consisting of different chemical compositions are extracted from roasted ground coffee at variable rates, with each of these compositions contributing to the production of taste and aroma normally associated with freshly-brewed coffee. Even a slight variation in the amounts of these various chemical compositions can result in a substantial and dramatic difference in both taste and aroma. As such, freshly-brewed coffee is usually at its peak of aroma and flavor immediately after brewing, and it begins to deteriorate in quality immediately thereafter. Typically, in about 20 minutes after brewing, the flavor and aroma of the coffee will have substantially changed, and the continuing chemical composition change of the coffee with time will effectively result in a complete undesirable change in both flavor and aroma within a couple of hours. Accordingly, much coffee is wasted from the fact that it has "aged in the pot" and is thus discarded in favor or brewing a new fresh container thereof. This, of course, results in considerable wastage of freshly-brewed coffee, as well as the required labor and loss of time associated with the brewing thereof.

Recognizing these problems, the coffee industry has been continually attempting to develop a manner of coffee brewing which will permit the coffee to be brewed one cup at a time, while retaining freshness in flavor and intensity of aroma. The major recognized attempt at achieving this result is to be found in the marketing of various soluble instant coffees, whereby freeze-dried or similarly processed granules of ground coffee are provided for direct deposition in hot water. As is well known by the coffee-consuming public, instant coffee has very lttle of the aroma and flavor intensity of freshly-brewed coffee. However, the consuming public has been willing to accept the loss of aroma and flavor in return for the ease of brewing just one cup at a time while not necessitating any substantial amount of wasted time or subsequent cleaning of an associated coffee-brewing apparatus.

Inasmuch as instant coffee has not proved to be an acceptable solution to the problem of permitting the rapid brewing of coffee which retains intense flavor and aroma characteristics and which may be brewed one cup at a time without creating a situation where substantial subsequent cleaning must be performed, there is a continuing search for improvements in the coffee-brewing industry for effecting such a desired result. An early approach is to be found in U.S. Pat. No. 2,291,278, which issued to Cleaves on July 28, 1942, wherein there is disclosed a coffee bag which includes a rigid handle attached directly to the bag so as to facilitate its handling. The bag is identified as being constructed of a gauze or porous paper in the form of a container which holds the ground coffee, while the handle may be utilized to position the bag in a cup of hot water. As noted in the Cleaves' patent, it was at that time already known to utilize coffee bags having a string and tag attached thereto.

The Cleaves' patent is representative of a large number of patents directed to porous coffee bags designed for direct immersion in hot water. A more recent patent is U.S. Pat. No. 3,607,302, which issued to Beck on Sept. 21, 1971, with there being disclosed therein a coffee bag formed in a tubular manner which permits water flow in a longitudinal direction through a center section of the bag. While both of the inventions disclosed in these patents function to brew coffee in the manner described, certain serious shortcomings exist.

In this connection, it should be noted that the brewing of an ideal cup of coffee involves the extraction or entering into solution of some certain percentage, normally approximately 19 percent, of the dry weight of the ground coffee. Additionally, this extraction process must be performed rather rapidly in those cases where a continual supply of boiling hot water is not available. In other words, the brewing process can be performed slowly in the case of a percolator inasmuch as a continual supply of boiling hot water is directed over the coffee grounds; however, in the processes disclosed by Beck and Cleaves, it can be appreciated that rapid temperature decrease of the water will be experienced upon an insertion of the coffee bags into the water. After only a partial cooling of the water, the resulting chemical reaction is such as to destroy or hinder the development of desired flavor and aroma characteristics. By experiment, it has been shown that coffee bags constructed in the form of the Beck and Cleaves devices may be left to soak in hot water without ever achieving a desirable brewed state in an acceptable period of time.

Much of the problem with achieving the desired brewed state with the Beck and Cleaves devices arises from the fact that upon its immersion in hot water, coffee instantly begins to generate a large amount of gases, which could be caused both by chemical reaction and by the heat-effected expansion of the ambient air trapped between the coffee grounds. At the same time, a first and small portion of water soluble aromatic and flavorable oils are released from the ground coffee beans, and these essential oils tend to mix with the generated gases and air trapped between the coffee grains within the bag. As the gases expand, strong and elastic bubbles eventually occupy all of the available free space within the bag and as such, these gases cause the associated coffee bag to inflate whereby the bag tends to float on the surface of the hot water and at the same time, the pressurized gas bubbles within the bag effectively restrict the permeation of water through the bag. Additionally, the trapped gas tends to shield the individual coffee grounds from direct contact with such water as does manage to permeate through the bag, thereby to further slow the brewing process. As above-mentioned, the temperature of the water is rapidly decreasing during the brewing process and within a very short period of time, the efficiency of the coffee brewing process substantially decreases although an individual coffee bag may still be immersed in the water.

The problem of gas accumulation within a coffee bag does not appear to be rectified by increasing the porosity of the gauze or porous bag utilized to construct the coffee bag. In this respect, some of the coffee grounds rapidly dissolve into a residue of a size which will pass through paper or other material which is too porous and in fact, the size of pores actually needed to permit efficient gas venting would result in a substantial amount of the coffee grounds passing through the bag walls and entering directly into the brewed coffee solution. As such, it is necessary to maintain the use of small pores to prevent the depositing of a large amount of coffee grounds and associated residue into the hot brewing liquid.

There have been some prior attempts to deal with the problem of gas accummulation in coffee bags. One early attempt is to be found in U.S. Pat. No. 3,257,212, which issued to Kasket on June 21, 1966, with this patent disclosing a non-floating beverage package. The Kasket disclosure notes that coffee bags "have a tendency to rise up in the cup due to captured air bubbles and the light density of the materials within the bag." In an effort to overcome this problem, Kasket makes use of a coffee bag attached to a rigid handle with a weight means then being attached to a bottommost portion of the handle, whereby the coffee bag is forcibly retained beneath the surface of the brewing liquid irrespective of the fact that gas accumulation within the bag may occur. While this technique may be effective for the brewing of certain bullions, tea, or the like, it still does not overcome the problem of gas accumulation within the bag, whereby liquid permeation is restricted and coffee ground contact with the liquid is substantially retarded. As such, a slow coffee brewing rate is still experienced, whereby temperature drop of the brewing liquid has a chance to occur before the coffee is fully brewed and high coffee flavor and aroma intensity is not realized.

A further attempt at overcoming the problem of gas accumulation within a coffee bag is to be found in U.S. Pat. No. 3,879,565, which issued to Einstman et al. on Apr. 22, 1975. In this patent, there is disclosed the containment of roasted and ground coffee in a brewing bag in the manner above-described, with a defoaming agent, such as a silicone, being added to the coffee to disperse foam generated within the bag and to improve the rate of extraction of the coffee material. The Einstman patent recognizes the problem of gas entrapment by noting that the entrapped gas tends to retard extraction of the coffee material by apparently preventing good contact between the coffee and the extracting liquid. Einstman also notes that the increasing of the porosity of the infusion bags in order to permit an escape of the generated gases does not work because the increased porosity permits increased amounts of coffee grounds to escape from a bag, thereby producing an unsightly accummulation of sediment in the cup.

The defoaming agent of Einstman is spray plated on the surface of the roasted and ground coffee as a dilute dispersion or an emulsion with it being emphasized that the defoaming agents employed must be edible. While possibly functioning in the manner desired, it can be appreciated that it is not desirable to mix defoaming agents or any other chemicals with coffee grounds inasmuch as this could effect the flavor and aroma, and in any respect, the consuming public is resistant to purchasing foods having little-understood chemicals intermixed therewith.

As opposed to the coffee bag approach, there have been various other attempts, which may have been more or less successful, at brewing ground coffee in the manner of instant coffee. For example, U.S. Pat. No. 2,260,858, which issued to Naef on Oct. 28, 1941, discloses a dispensing device for making aromatic beverages which relies upon the use of a glass coffee grounds-holding container through which a plurality of perforations extend, whereby water may flow through the container and into contact with the coffee grounds. Of course, as abovediscussed, this construction permits substantial residue to accumulate in the brewed liquid and is thus undesirable. It should be noted that the construction illustrated in the Naef patent is illustrative of a plurality of such devices disclosed in the prior patent art. As such, it can be appreciated that there is a continuing need for improvement in the coffee brewing art, both with regard to apparatuses and methods for rapidly brewing ground coffee, and in this respect, the present invention substantially fulfills this need.

SUMMARY OF THE INVENTION

The general purpose of the present invention, which will be described subsequently in greater detail, is to provide new and improved coffee brewing apparatuses and methods which have all of the advantages of the prior art coffee brewing apparatuses and methods and none of the disadvantages. To attain this, the present invention envisions the use of a coffee brewing apparatus formed from a flexible plastic material, such as polypropylene or the like, or from any other suitable material, e.g., paper, metal, etc. The apparatus includes a coffee grounds retaining container or housing having at least one wall formed from a porous membrane, such as porous filter paper, gauze, or the like. In a preferred embodiment, two opposed walls will be formed from the porous material, whereby a desired flow of water through the housing can be achieved when the housing is moved about within a container of hot water. Integrally or otherwise attached to the housing is a handle portion to facilitate the positioning and movement of the housing within a container of hot water, such handle portion being of a hollow construction with its remote end being open to the ambient atmosphere, thereby to provide a venting effect between the interior of the coffee grounds-retaining container and the atmosphere. This construction provides a channel through which gas generated during an admixing of the coffee with the water may be vented out of the container, thus to assure against gas interference during the coffee brewing process.

While the preferred embodiment of the invention essentially relies upon a coffee grounds-retaining container of a substantially porous construction and having a vent from an interior portion of the container, additional embodiments of the invention rely upon the use of the generated gas to promote coffee grounds agitation. More particularly, recognizing that the generated gas will move upwardly towards the hollow handle of the invention, various baffles may be provided interiorly of the container whereby the gas is required to follow a tortuous or some other desired path in a manner where the moving gas bubbles will effectively agitate the coffee grounds. The baffles may be provided with sufficiently large perforations to permit the gas to move therethrough, while any coffee grounds which might otherwise move through these perforations will still be retained within the container and will be too heavy to move upwardly with the gas out of the handle. As such, the coffee grounds will remain in contact with the hot water while being agitated by the gas, and at the same time, the grounds will be prevented from going into solution with the brewed coffee, whereby undesirable residue would be deposited in the coffee.

To preserve the freshness of the coffee retained in the various embodiments of the invention, it is envisioned that each of the embodiments will be sealed in a vacuum pack until used. Such vacuum packaging could constitute individual heat sealed packages wrapped about each individual coffee brewing device or alternatively, one large vacuum sealed container could be employed, whereby a plurality of the coffee brewing devices comprising the present invention could be retained within the container. All of the devices retained within one container would be protected againt staleness as long as the vacuum seal is maintained.

It is therefore an object of the present invention to provide new and improved coffee brewing apparatuses which have all of the advantages of the prior art coffee brewing apparatuses and none of the disadvantages.

It is another object of the present invention to provide new and improved coffee brewing apparatuses which may be easily and efficiently manufactured and marketed.

It is a further object of the present invention to provide new and improved coffee brewing apparatuses which may be efficiently and reliably used to brew coffee.

Even another object of the present invention is to provide new and improved coffee brewing apparatuses which are of a durable and non-contaminating construction.

Still another object of the present invention is to provide new and improved coffee brewing apparatuses which eliminate the problem of gas interference with a coffee brewing process.

Yet another object of the present invention is to provide new and improved coffee brewing apparatuses which may be utilized to brew coffee in a manner similar to soluble instant coffee without any attendant loss in flavor or aroma intensity.

Still yet another object of the present invention is to provide new and improved coffee brewing devices which are characterized by a portable and lightweight construction whereby the same can be conveniently stored in a vacuum-sealed container.

An even further object of the present invention is to provide new and improved coffee brewing devices which are susceptible of a low cost of manufacture with regard to both materials and labor, and which accordingly are then susceptible of low prices of sale to the consuming public, thereby making such devices economically available to the buying public.

Still yet another object of the present invention is to provide new and improved coffee brewing devices and methods which provide some of the advantages of the apparatuses and methods of the prior art, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

DESCRIPTION OF THE PREFERRED EMBODIMENTS

Figure 1:
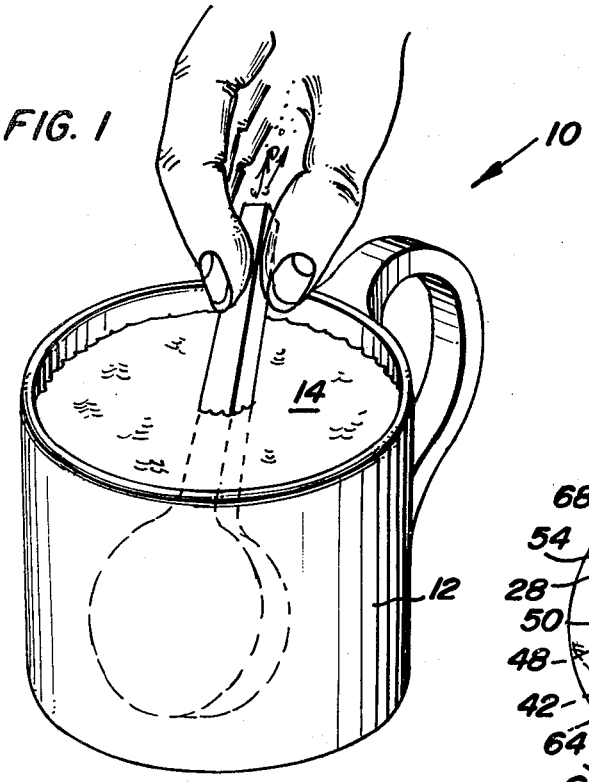
FIG. 1 is a perspective view illustrating the manner of use of each of the embodiments of the present invention.
Figure 2:
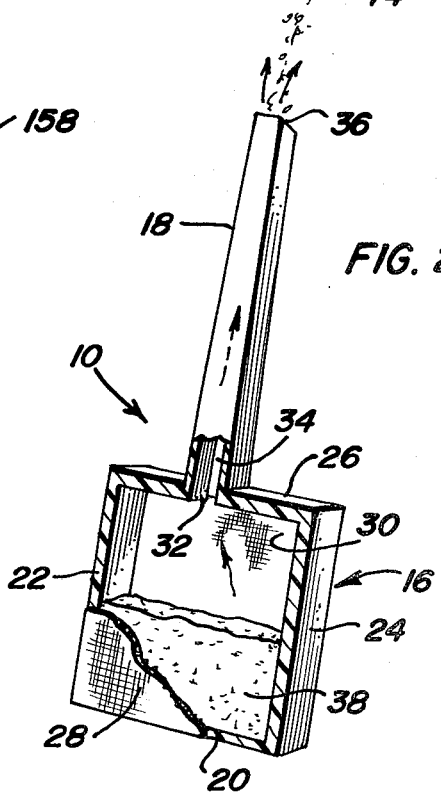
FIG. 2 is a perspective view of a first embodiment of the coffee brewing apparatus comprising the present invention.

With reference now to the drawings and in particular to FIGS. 1 and 2 thereof, a new and improved coffee brewing device embodying the principles and concepts of the present invention and generally designated by the reference numeral 10 will be described. In this respect, it can be seen that the coffee brewing device 10 is designed to be directly inserted into a cup 12 of hot water 14 whereby the same may be stirred about to brew a cup of coffee. As best shown in FIG. 2, the brewing device 10 may be of a continuous integral construction and includes a coffee retaining housing or container portion 16 and a handle 18 attached to a topmost portion thereof. In its preferred embodiment, the device 10 will be constructed of some insoluble plastic material, such as polypropylene or the like; however, it is to be understood that it is within the purview of the present invention to utilize any known materials, e.g., paper, metal, etc., which would effectively permit the invention to perform in the manner desired.

With continuing reference to FIG. 2 of the drawings, it will be noted that the housing 16 is of a substantially rectangular construction and includes a bottom wall 20, a pair of respective sidewalls 22, 24 integrally attached thereto, and an integrally attached topwall 26 which completes the rectangular configuration. The two remaining opposed sidewalls 28, 30 are formed from some known porous material and are completely attached around the respective perimeters of the rectangular housing 16 whereby a substantially enclosed housing is formed.

The porous sidewalls 28, 30 may be attached to the respective perimeters of the housing 16 in any known and conventional manner. It is also within the purview of the invention to have the sidewalls 28, 30 in connecting engagement whereby a bag-like construction is formed, with such bag construction then being positioned within the interior portion of the housing 16. As such, all known attachment and arrangement means which assist in accomplishing the function of brewing fresh coffee are within the intent of the described invention. With respect to the material from which the porous sidewalls 28, 30 are formed, in the preferred embodiment, such material is envisioned as being a porous filter paper. However, other insoluble filtering materials, such as gauze or the like, may be successfully utilized dependent only upon the size of the porous openings in the material.

Continuing with the discussion of the embodiment of the invention shown in FIG. 2, it can be seen that the topwall 26 is provided with a through-extending aperture 32 and that the handle 18 is of a hollow construction whereby a conduit 34 is formed within the handle Further, the conduit 34 extends completely through the handle 18 whereby the remote free end 36 of the handle defines an opening by which fluid communication is established between the interior of the housing 16 and the ambient atmosphere. This conduit 34 serves as a vent to the atmosphere whereby gases which would normally be trapped within the housing 16 can be vented therefrom. More specifically, when coffee 38 is utilized to partially or completely fill the interior of the housing 16 and when the housing is then immersed in hot water 14 as shown in FIG. 1, a substantial amount of gases are generated, with the conduit 34 then serving as the vent for removing these gases from the proximity of the coffee 38.

Figure 3:
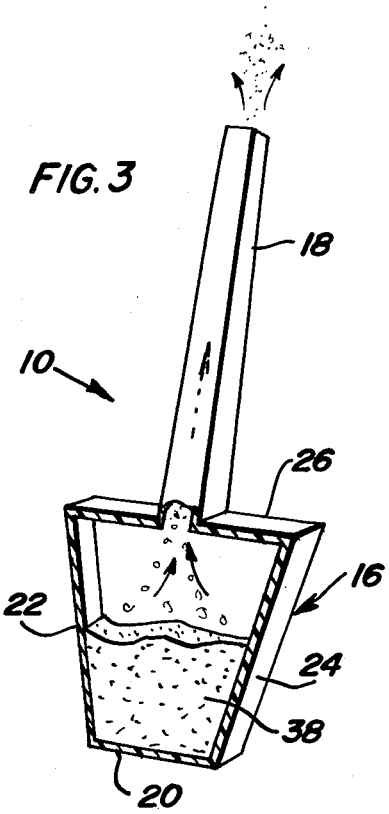
FIG. 3 is a perspective view of the first embodiment of the invention wherein the coffee-containing portion is of a modified shape.
Figure 4:
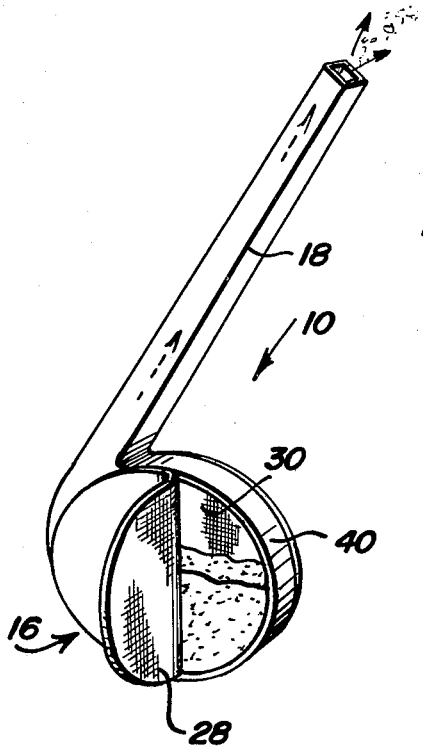
FIG. 4 is a perspective view of the first embodiment of the invention showing a further differently shaped coffee-containing portion.

FIGS. 3 and 4 of the drawings have been provided to illustrate the flexibility of design and shape which is inherent in the invention 10. More particularly, FIG. 3 is illustrative of the fact that the rectangular housing 16 could be of a trapezoidal shape to accomplish a desired conforming fit within an associated cup 12. By the same token, the respective walls 20, 22, 24, 26 could each be varied into an infinite number of different lengths to obtain any type of angulated arrangement, with all such arrangements being within the purview of the present invention. Of course, it is to be understood that the substantially orthogonally-aligned sidewalls of the illustrated handle 18 could be dispensed with, whereby the same could be of a tubular construction with the exact shape and design of the handle being variable as desired.

By the same token, FIG. 4 illustrates the fact that the angulated sidewall construction of the housing 16 can be dispensed with whereby the same is designed with one continuous curvilinear wall 40 with the other components of the invention remaining the same. The curvilinear construction of the invention shown in FIG. 4 is particularly useful for those individuals who like to rest their hand upon the cup supporting surface while at the same time gradually stirring the device 10 within a cup 12. As such, the curvilinear construction of the invention shown in FIG. 4 is representative of all conceivable configurations of curvilinear walls, whether integrally or separably attached together.

Figure 5:
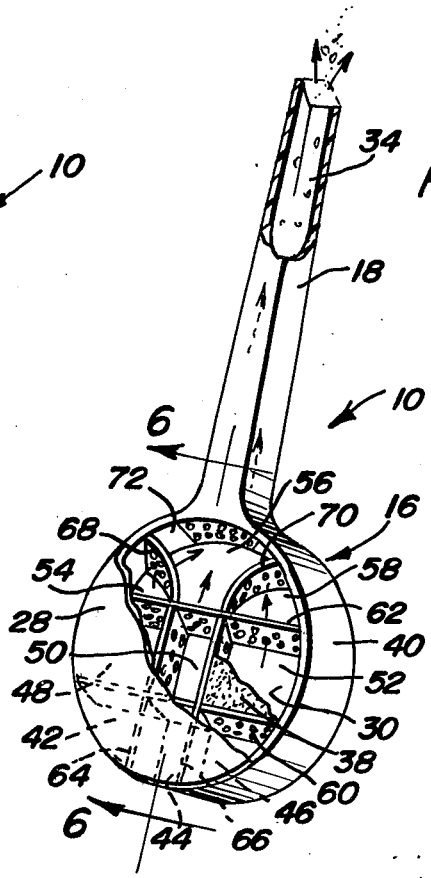
FIG. 5 is a perspective view of a second embodiment of the invention, wherein the coffee-containing housing is provided with gas directing baffles.
Figure 6:
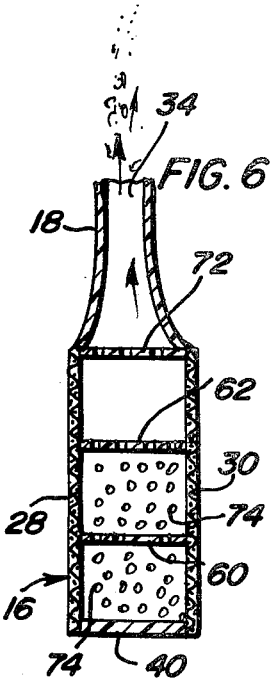
FIG. 6 is a cross-sectional view of the second embodiment of the invention taken along the line 6—6 in FIG. 5.

While FIGS. 1–4 of the drawings have depicted a preferred first embodiment of the invention, with this embodiment being in its simplest form, FIGS. 5 and 6 illustrate a second embodiment of the invention which is more elaborately designed. In this connection, it can be seen that the coffee brewing device 10 is shown formed from a curvilinear wall 40 and an integrally attached handle 18 with such handle being provided with the afore-described venting conduit 34. Further, opposed porous sidewalls 28, 30 are provided whereby a substantially closed-in housing 16 is defined. Inasmuch as the previous embodiment of the invention illustrated the positioning of ground coffee 38 within the housing 16 in a manner where all of the coffee is compacted together, the embodiment of the invention illustrated in FIG. 5 makes provision for separating the coffee into a plurality of compartments 42, 44, 46, 48, 50, 52, 54, 56 and 58. While this embodiment of the invention illustrates nine compartments, it is to be understood that regardless of the number of compartments shown in any of the embodiments of the invention yet to be described, such is only illustrative in nature and that any conceivable number of compartments are within the intent of the invention.

Further referencing the embodiment of the invention shown in FIGS. 5 and 6, it will be noted that the compartments 42, 44, 46, 48, 52, 54, 56 and 58 are essentially completely defined by a pair of parallel baffles or walls 60, 62 extending completely across the interior of the housing 16 and being substantially orthogonally aligned and intersectingly interconnected with a further pair of baffles 64, 66. This further pair of baffles 64, 66 also extends substantially across the interior portion of the housing 16 and if desired, the baffles 64, 66 may have first respective ends 68, 70 thereof curved in the illustrated manner so as to assist in the design function yet to be described. A final baffle 72 may be positioned across the aperture 32 so as to effectively serve as a partial block to gas being vented upwardly through the venting conduit 34.

With respect to the function of the individual compartments 42, 44, 46, 48, 50, 52, 54, 56 and 58, there is shown some ground coffee 38 positioned in compartment 52 with it being understood that some such coffee would be positioned in each of the aforedescribed compartments. Further, it will be noted that each of the baffle walls 60, 62, 64, 66 and 72 are of a substantially perforated design to include a plurality of perforations 74 extending therethrough. The perforations 74, as best shown in FIG. 6, are of such a sufficient size as to permit an easy flowthrough of gases generated during a brewing process, with such perforations serving to guide the direction of flow of gas through respective amounts of ground coffee 38 contained in each of the compartments 42, 44, 46, 48, 50, 52, 54, 56 and 58. As such, rather than permitting a direct venting of the gases upwardly through the venting conduit 34 to the atmosphere as in the embodiment of the invention shown in FIGS. 1–4, in the second embodiment of the invention, the generated gases are still vented to the atmosphere but are first utilized to pass through respective amounts of coffee 38 contained in at least compartments 48, 50, 52, 54, 56 and 58, whereby the gas is broken into a plurality of small bubbles by the perforations 74 and is then utilized to agitate the coffee 38 within the compartments to assist in the brewing process. This gas agitation of the ground coffee 38 effects a more thorough intermixing of the ground coffee with the hot water 14 passing through the porous sidewalls 28, 30. Of course, as can be readily understood, the generated gas bubbles continue to pass upwardly through the perforations 74 whereby eventual venting of the gases is effected through the conduit 34.

With respect to the construction of the baffles 60, 62, 64, 66 and 72, it is expected that the same would normally be constructed from a thin flexible plastic material, such as polypropylene or the like, or some other water insoluble material. In the most desired form, the entire brewing device 10 would be constructed of a very flexible, thin plastic material, such as the aforementioned polypropylene, to include the baffles 60, 62, 64, 66 and 72, whereby once the brewing device has been utilized to brew a cup of coffee, a user could remove the device from the brewed cup of coffee and could then briefly squeeze the device whereby the walls would flex and permit a final drainage of water 14 from the interior of the housing 16.

Figure 7:
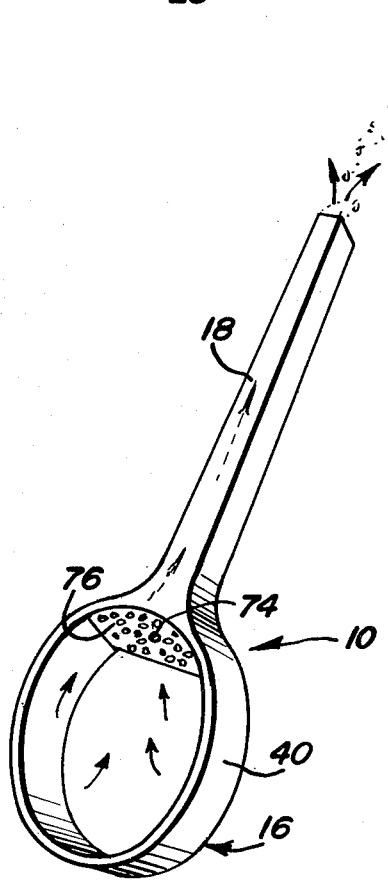
FIG. 7 is a perspective view of a third embodiment of the invention wherein only one gas-directing baffle is utilized.

FIG. 7 of the drawings illustrates a further embodiment of the invention 10 whereby the housing 16 is formed of a curvilinear sidewall 40 with an integrally attached venting handle 18 being formed as a part thereof. In this embodiment of the invention, only one baffle 76 is employed within the interior of the housing 16. As shown, the baffle 76 includes a plurality of through-extending perforations 74 and is positioned over the afore-described aperture 32 in a manner which partially blocks the entrance of escaping gas into the conduit 34 positioned within the handle 18. This construction of the invention operates to prevent coffee grounds 38 from being moved upwardly into the conduit 34 during a stirring operation whereby the device 10 is inserted into a cup of hot water 14. More specifically, where the baffle 76 is not employed and depending upon the depth of insertion of the device 10 into a cup of hot water 14, the water will serve to initially force the coffee grounds 38 upwardly into the conduit 34 contained in the handle 18, thereby to block gas flow from the interior of the housing 16. Once the coffee grounds 38 have moved into the conduit 34, it could conceivably be difficult to effectively force them back down into the interior of the housing 16 and regardless of whether or not gas flow continues to move within the conduit 34, at least some of the coffee grounds 38 would not be thoroughly mixed with the hot water 14. This would effect the quality of the brewed coffee and as such, the baffle 76 could in some cases constitute an important part of the invention. Of course, it is to be understood that this embodiment of the invention, as well as embodiments already or yet to be described, is constructed of the same insoluble materials, such as flexible or rigid plastic or some other insoluble material which would permit a use of each of the embodiments of the invention without any danger of the components thereof going into solution with the hot water 14.

Figure 8:
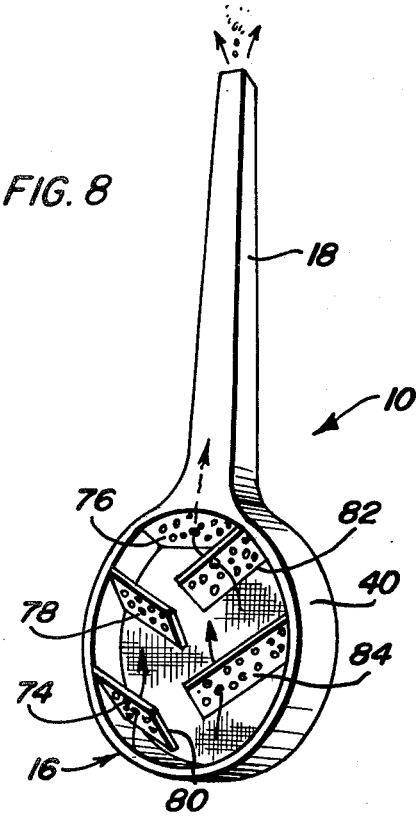
FIG. 8 is a perspective view of a fourth embodiment of the invention, wherein several disconnected angulated baffles are utilized.

FIG. 8 illustrates a fourth preferred embodiment of the invention, with this embodiment essentially including all of the components of the invention illustrated and described with respect to the third embodiment of the invention, as shown in FIG. 7, and further including four additional baffles 78, 80, 82 and 84. As illustrated, the baffles 78, 80, 82 and 84 each have first ends thereof fixedly secured to an interior portion of the curvilinear sidewall 40 with their remaining free ends being in a disconnected relationship with respect to one another. Further, two of the baffles 78, 80 may be substantially paralledly aligned and angulated downwardly within the interior of the housing 16, while the remaining two baffles 82, 84 may be similarly substantially paralledly aligned and angulated downwardly within the interior of the housing in a manner which is substantially angulated with respect to the baffles 78, 80. This construction is illustrated as a matter of interest and depicts the flexibility of design with regard to the arrangement of any number of baffles within the housing interior 16.

As can be appreciated with respect to the embodiment of the invention shown in FIG. 8, the downward angulation of each of the baffles 78, 80, 82 and 84 permits a capturing of ground coffee 38 as the same attempts to move upwardly within the interior of the housing 16 during an immersion of the brewing device 10 into hot water 14. This of course prevents clogging of the conduit 34 positioned within the handle 18, while at the same time, each of the baffles 78, 80, 82 and 84 are provided with the aforedescribed through-extending perforations 74 whereby effective gas flow upwardly towards the conduit 34 is permitted. The gas flow moving through the perforations 74 of course agitates the coffee grounds 38 in the manner aforedescribed to thereby assist in the brewing process, and the baffle 76 serves as a final means of preventing coffee ground movement upwardly into the conduit 34 where some such coffee is not retained within the angularly-shaped chambers formed by the baffles 78, 80, 82 and 84.

Figure 9:
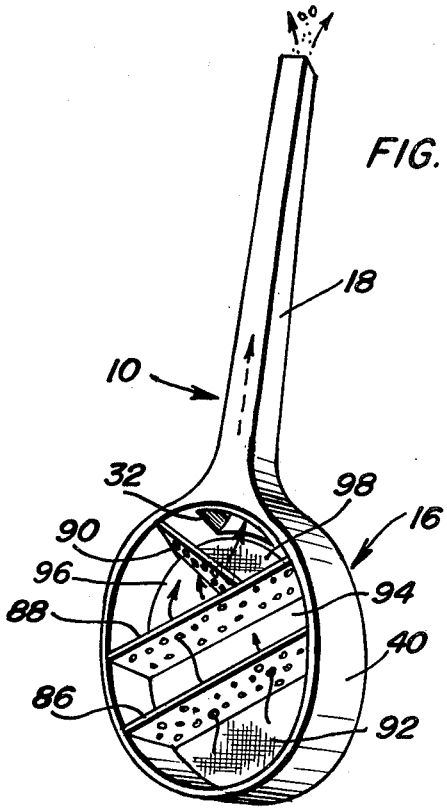
FIG. 9 is a perspective view of a fifth embodiment of the invention wherein one detached and two adjoining baffles are utilized.

FIG. 9 is provided of interest as disclosing a fifth embodiment of the invention, with this embodiment being illustrative of the flexibility of design with respect to baffle positioning within the housing 16. This embodiment of the invention 10 includes the aforedescribed housing 16 having a curvilinear wall shape 40 and integral handle 18 provided with the venting conduit 34, and further includes baffles 86, 88 and 90, each of which is provided with through-extending apertures 74 in a now well understood manner. The baffles 86 and 88 are aligned substantially parallel to one another within the housing 16 and are in a spaced-apart relationship with their respective ends fixedly secured to the interior of the curvilinear wall 40, while the further baffle 90 is angularly positioned with respect to the baffle 88 and has a first end fixedly secured to the interior of the curvilinear wall 40 and second end fixedly or otherwise secured to the baffle 88 in the manner illustrated. As such, three coffee retaining compartments 92, 94, 96 are defined with it being understood that gas generated in compartment 92 will move upwardly into compartment 94 to thereby agitate the coffee grounds 38 contained therein, while at least a portion of the gas generated or otherwise contained in compartment 94 will move upwardly through compartment 96 to further effect desired coffee intermixing with the hot water 14. A final compartment 98 is shown as a gas collection compartment with the aperture 32 and conduit 34 being in fluid communication with this compartment whereby the gas may be finally vented to the atmosphere. This construction of the invention provides for an increased capacity gas collection chamber 98 to further facilitate gas venting to the atmosphere without the attendant aforedescribed clogging of the aperture 32 and its associated conduit 34 by the accummulation of coffee grounds 38 therein.

Figure 10:
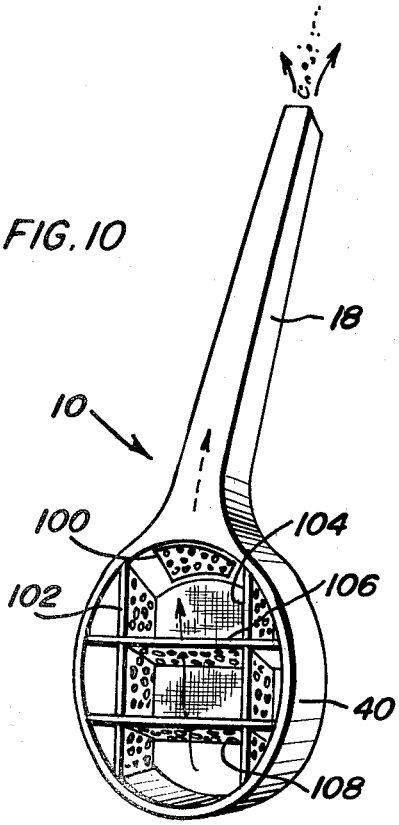
FIG. 10 is a perspective view of a sixth embodiment of the invention wherein the baffles are arranged in a pattern similar to the baffle arrangement of the second embodiment.
Figure 11:
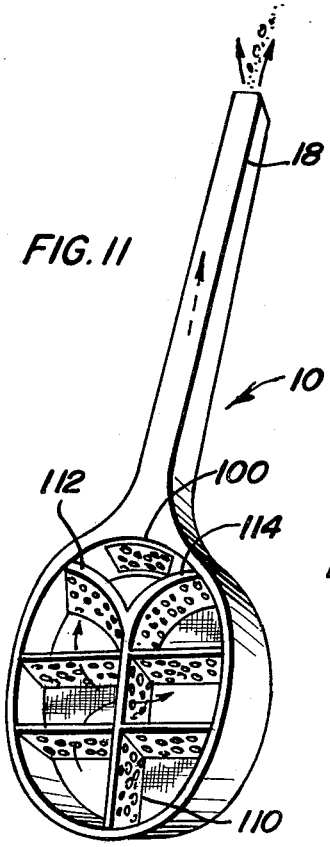
FIG. 11 is a perspective view of a seventh embodiment of the invention wherein only one centrally-positioned, axially-aligned baffle is utilized in combination with several angulated baffles.
Figure 12:
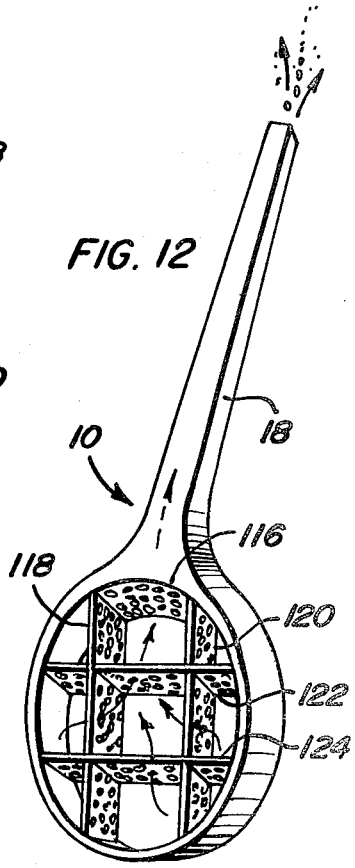
FIG. 12 is a perspective view of an eighth embodiment of the invention, wherein all of the utilized baffles are substantially orthogonally aligned with respect to one another.

FIGS. 10, 11 and 12 are essentially provided of general interest to illustrate slightly modified embodiments of the invention, thereby to thoroughly emphasize the flexibility of design intended in describing each of the embodiments of the invention. For example, inasmuch as the second embodiment of the invention illustrated in FIG. 5 describes a continuous baffle 72 positioned proximate to the aperture 32 whereby the ends of such baffle would normally be in a fixed or touching engagement with the respective curved ends 68, 70 of the baffles 64, 66, the sixth embodiment of the invention shown in FIG. 10 illustrates a baffle 100 which is positioned directly over the aperture 32 and which has its remote edges free from contact with the further illustrated baffles 102, 104. Further, the baffles 102, 104, which are substantially similar to the baffles 64, 66 shown in FIG. 5, are of a substantially straight continuous construction, whereby the curved ends 68, 70 associated with the respective baffles 64, 66 have been dispensed with. If desired, intermediate orthogonally-aligned, interconnecting baffles 106, 108 may be provided in a manner similar to the construction of the second embodiment of the invention.

FIG. 11 then illustrates a further optional design whereby the baffles 64, 66, as shown in FIG. 5, have been effectively combined into a single baffle 110 which is of a split construction so as to branch out into a pair of curved ends 112, 114, such curved ends being similar to the curved ends 68, 70 shown with respect to the second embodiment of the invention. The aforedescribed separably connected baffle 100 is also illustrated, as was described with respect to the sixth embodiment of the invention shown in FIG. 10, and it is to be understood that such a branched configuration of a baffle 110 could be employed with any number of baffles to further alter the design configuration of the brewing device 10.

FIG. 12 is provided of interest as disclosing a final optional configuration of the invention to include a baffle 116 positioned proximate to the aperture 32 and having its free edges fixedly secured to or in touching contact with a pair of substantially straight baffles 118, 120, while some number of intermediate, substantially orthogonally-aligned, interconnecting baffles 122, 124 may be employed as desired.

Figure 13:
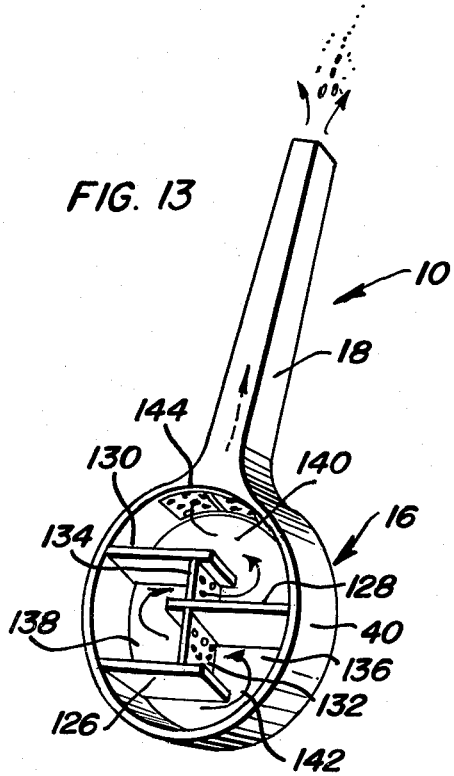
FIG. 13 is a perspective view of a ninth embodiment of the invention, wherein both perforated and non-perforated baffles are utilized.

FIG. 13 of the drawings illustrates a ninth embodiment of the invention with this embodiment including the aforedescribed housing 16 having a curvilinear wall 40 and integrally attached handle 18 provided with a venting conduit 34. Further illustrated with respect to this embodiment are three substantially parallel baffles 126, 128, 130, such baffles being of a non-perforated design with two of the baffles 126, 130 having ends thereof attached to a first side of the sidewall 40 and the second baffle 128 having a first end fixedly secured to an opposed interior side of the sidewall 40. As illustrated, a further pair of baffles 132, 134 may then be substantially orthogonally-aligned with the baffles 126, 128, 130 fixedly secured thereto, whereby the baffle 132 is fixedly secured between the baffles 126, 128 and the baffle 134 is fixedly secured between the baffles 128, 130. As such, at least three compartments 136, 138, 140 are defined wherein ground coffee 38 may be retained. Inasmuch as the afore-described porous sidewalls 28, 30 are similarly utilized to enclose the housing 16 in this embodiment of the invention, as with all of the embodiments of the invention subsequently described, a tortuous path, as illustrated by the arrows 142, is defined for gas flow through the housing 16.

In this construction of the invention, the gas generated in compartment 136 is directed along the tortuous path 142 which substantially increases the distance within the housing 16 that the gas must move prior to its entry into the conduit 34. Accordingly, this construction of the invention utilizes to a greater extent the effective agitation caused by the movement of the gas through the coffee grounds 38. As illustrated, the design may include a baffle 144 which extends over only a partial portion of the aperture 32 to even further increase the length of the tortuous path 142, thereby to obtain optimum gas agitation of the brewing coffee grounds 38. Of course, it is to be understood that any number of non-perforated baffles 126, 128, 130 could be used in combination with angularly-aligned perforated baffles 132, 134 to thus define any type of path for gas flow as desired.

Figure 14:
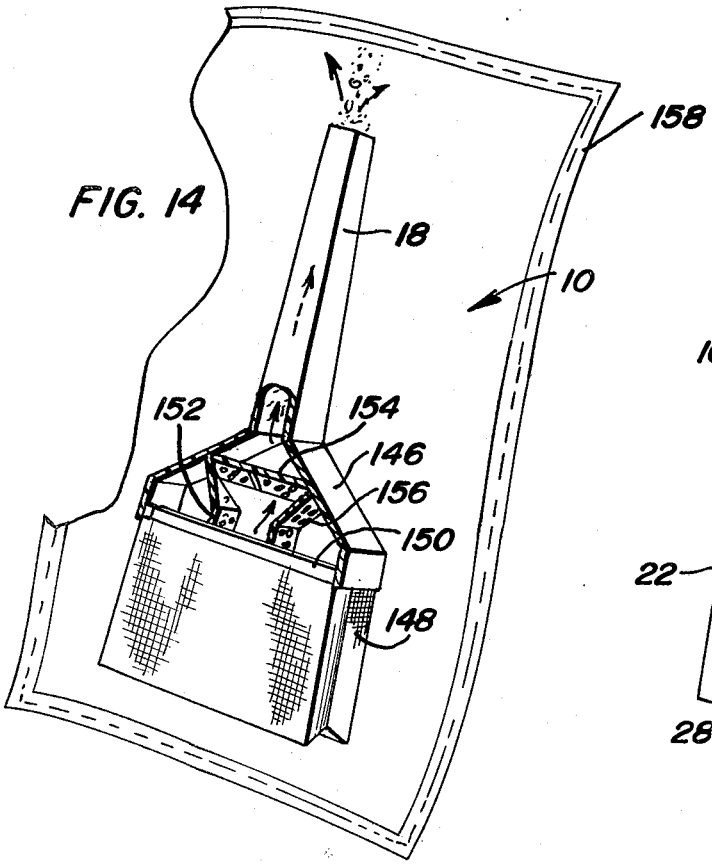
FIG. 14 is a perspective view of a tenth embodiment of the invention, wherein the coffee-containing portion is formed in the manner of a flexible porous bag.

FIG. 14 illustrates a tenth and final embodiment of the invention wherein the substantially enclosed housing 16 has been dispensed with in favor of an open housing 146. In this regard, the housing 146 is illustrative of any number of open sidewall designs which could be employed to retain a coffee ground container 148 formed as a substantially closed bag and constructed from a porous material. More specifically, in this design of the invention, an upper portion 150 of the bag 148 should be provided with an open slot or some other type of opening which would serve to permit gas flow upwardly into the interior of the housing 146. The bag 148 could be constructed in the manner of a conventional tea bag and would have its upper edge portion 150 in sealing engagement with the housing 146, whereby all generated gas would flow into the interior of the housing and no coffee grounds 38 could move into solution with the hot water 14. Further illustrated with respect to this embodiment of the invention is the use of a plurality of angulated baffles 152, 154, 156 which function in the aforedescribed manner. No specific description of the construction or arrangement of the baffles 152, 154, 156 is necessitated inasmuch as it is to be understood that any number of such baffles could be utilized and such baffles could be angulated or otherwise arranged in any of the aforedescribed manners, as well as any other conceivable manner.

By the same token, it is within the purview of this invention to utilize a substantially enclosed porous coffee container 148 in combination with the first embodiment of the invention, as illustrated in FIG. 2. In this respect, the substantially enclosed container 148 could be positioned within the interior of the housing 16, as shown in FIG. 2, while some conventional means could then be utilized to effectively seal the uppermost portion 150 of the container within the housing 16, thereby to prevent coffee grounds 38 from moving into solution with the hot water 14, while still permitting the invention to operate in the aforedescribed manner.

FIG. 14 lastly illustrates the fact that the tenth embodiment of the invention, as well as all other described embodiments, could be normally packaged within a sealed container 158. The sealed container 158, which in a preferred embodiment might be an evacuated heat-sealed flexible plastic bag, serves to prevent air contact with the coffee grounds 38 prior to a use of the brewing device 10, whereby the coffee grounds will be prevented from becoming stale. As a probable preferred alternative to the use of individual evacuated heat-sealed packages 158, a plurality of the brewing devices 10 could be packaged in some form of metallic, plastic or paper container which is then evacuated. This construction might be similar to a commercially available can of coffee which is conventionally vacuum packed and as aforediscussed, once the storage container has been opened, it would be desirable to utilize all of the brewing devices stored therein within a reasonable period of time, so as to prevent coffee quality deterioration due to staleness.

With respect to the manner of use of each of the embodiments of the present invention, it is now apparent that a user would only need to remove one of the brewing devices 10 from its storage container, which might be an evacuated bag 158, and being provided with a cup 12 of hot water 14, he need only then to insert the brewing device into the water in the manner illustrated in FIG. 1. The brewing device 10 may then be stirred within the water 14 through an accommodating use of the handle 18 for a period of one minute or less. During this stirring operation, the ground coffee 38 retained within the housing 16 will be intermixed with water 14 permeating through the porous sidewalls 28, 30 and as a result of such admixing, gases will be generated. These gases will be vented upwardly through the conduit 34 formed in the handle 18.

Depending upon which embodiment of the invention is utilized, the gas may be directed through a plurality of baffles having perforations 74, whereby the gas bubbles are broken into smaller bubbles and are utilized to agitate the coffee grounds 38 retained within the housing 16, thereby to further accelerate and expedite the intermixing of the coffee grounds with the water 14. Depending upon baffle arrangement, whether such baffles are of a perforated or non-perforated design, the gas bubbles will eventually be directed upwardly into the conduit 34 so as to be ejected to the atmosphere and thus, the gas is prevented from substantially interfering with the brewing of the ground coffee 38 with the water 14.

After the coffee has been brewed to the desired consistency and the desired flavor and aroma characteristics have been recognized, the brewing device 10 may be extracted from the coffee, squeezed if desired to remove excess water 14 therefrom, and may then be conveniently discarded. While in the preferred embodiment, the brewing device has been described as being of a disposable construction, whereby one brewing device 10 is utilized to mix one cup of fresh coffee and is then permanently disposed of, it is within the purview of this invention to provide a re-usable brewing device whereby separable porous coffee holding containers 148 may be employed. In this latter form of the invention, the ground coffee 38 might be packaged in disposable porous bags 148 similar in appearance to commercially-available tea bags and would be designed for insertion into the reusable brewing device 10 for a one-use brewing operation. Once a cup of coffee has been brewed then, the porous bag 148 could be removed and disposed of while the handle 18 with its integral housing structure would be retained for further future use.

With respect to the above-description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of invention.

What is claimed as being new and desired to be protected by Letters Patent of the United States is as follows:

1. A coffee brewing device for rapidly brewing coffee, said device comprising housing means containing a supply of ground coffee, said housing means being at least partially submersible in a liquid means to effect said brewing of said coffee, self-supporting elongated handle means dimensioned to be hand held and attached to said housing means for facilitating positioning and stirring of said housing means in said liquid means, said housing means having opposed relatively narrow, self-supporting sidewalls with opposed relatively wide porous walls of said housing means extending intermediate said narrow sidewalls to facilitate an intermixing of said supply of ground coffee with said liquid means during said brewing, vent means being provided in an upper portion of said housing means for permitting a rapid venting of gases from an interior portion of said housing means, said gases being generated during said brewing, and baffle means structurally fixed to said housing means and defining a plurality of at least partially closed compartments within said housing means which contain and retain coffee and enable gases generated in said compartments during brewing to be vented from the interior of said housing means by said vent means.

2. A coffee brewing device according to claim 1, wherein said baffle means defines a plurality of essentially closed compartments within said housing means which contain and retain coffee and enable gases generated in said compartments during brewing to be vented from the interior of said housing means by said vent means.

3. A coffee brewing device according to claim 1, wherein said baffle means includes an interior baffle extending inwardly from a wall of said housing means.

4. A coffee brewing device according to claim 3, wherein said interior baffle is provided with at least one through-extending perforation through which generated gas may pass to be vented from said housing means by said vent means.

5. A coffee brewing device according to claim 3, wherein said interior baffle is provided with a plurality of through-extending perforations through which generated gas may pass to be vented from said housing means by said vent means.

6. A coffee brewing device according to claim 1, wherein said baffle means includes an interior baffle which is of a non-perforated construction so as to control a direction of flow of said gases through the interior of said housing means.

7. A coffee brewing device according to claim 1, wherein said plurality of at least partially closed compartments include a first lower compartment and a second relatively higher compartment and wherein said baffle means enables the gases produced in said first lower compartment to move into and agitate coffee retained in said second higher compartment.

8. A coffee brewing device according to claim 1, wherein said baffle means extends completely across the interior of said housing means.

9. A coffee brewing device according to claim 1, wherein said opposed relatively narrow self-supporting sidewalls of said housing means are formed of a thin flexible material whereby once the brewing device has been utilized to brew coffee it can be removed from the coffee and squeezed to drain coffee from the interior of said housing means.

10. A coffee brewing device according to claim 9, wherein said opposed relatively narrow self-supporting sidewalls of said housing means are continuous sidewalls which are formed of a thin plastic material.

11. A coffee brewing device according to claim 1, wherein said vent means is formed in said handle means.

12. A coffee brewing device according to claim 11, wherein said vent means includes a conduit means extending through an axial length of said handle means, said conduit means establishing fluid communication between said interior portion of said housing means and a surrounding atmosphere.

13. A coffee breewing device according to claim 1, wherein said porous walls are constructed from a porous filter paper.

14. A coffee brewing device according to claim 1, and further including wall means for controlling a positioning of said supply of said ground coffee within said interior portion of said housing means, said wall means being positioned approximate said vent means, whereby said supply of ground coffee is prevented from moving into said vent means during said brewing.

15. A coffee brewing device according to claim 14, wherein said wall means includes at least one perforation for permitting a flow of said gases past said wall means into said vent means while substantially preventing a flow of said supply of ground coffee into said vent means.

16. A coffee brewing device according to claim 1, wherein said baffle means includes at least one non-perforated baffle and at least one perforated baffle, whereby a flow direction of said gases within said interior portion of said housing means may be diverted to increase a duration of gas flow within said housing means, thereby to more effectively agitate said supply of said ground coffee during an intermixing thereof with said liquid means.

17. A process for rapidly brewing coffee with a coffee brewing device according to claim 1 comprising the steps of at least partially submerging the housing means of said device into a liquid and allowing said liquid to permeate through the porous housing means to intermix with the coffee in the plurality of at least partially closed compartments of said device and venting gases generated in said plurality of compartments during an intermixing of said liquid with said coffee through vent means in an upper portion of the housing means.

18. A process for rapidly brewing coffee according to claim 17, and further including the step of controlling the flow of said gases in said porous housing means, said controlling including at least one of controlling bubble size of said gases and a direction of flow of said gases within said porous housing means, thereby to utilize said gases to effectively agitate and promote an intermixing of said liquid with said coffee.

19. A coffee brewing device for rapidly brewing coffee, said device comprising housing means containing a supply of ground coffee, said housing means being at least partially submersible in a liquid to effect said brewing of said coffee, self-supporting elongated handle means dimensioned to be hand held and attached to said housing means for facilitating positioning and stirring of said housing means in said liquid means, said housing means having opposed relatively narrow self-supporting sidewalls with opposed relatively wide porous walls of said housing means extending intermediate said narrow sidewalls, vent means being provided in an upper portion of said housing means for permitting a rapid venting of gases from the interior of said housing means, said gases being generated during brewing, and baffle means structurally fixed to said housing means and defining a plurality of at least partially closed compartments within said housing means which contain and retain coffee during brewing while permitting gases generated in said compartments during brewing to be vented from the interior of said housing means by said vent means, said compartments extending between said relatively wide porous walls of said housing means whereby the intermixing of said liquid and the coffee in said compartments is facilitated for rapid brewing.

20. The process for rapidly brewing coffee with a coffee brewing device according to claim 19 comprising the steps of at least partially submerging the housing means of said device into a liquid and allowing said liquid to permeate through the porous housing means to intermix with the coffee in the plurality of at least partially closed compartments of said device and venting gases generated in said plurality of compartments during an intermixing of said liquid with said coffee through vent means in an upper portion of the housing means.

21. A process for rapidly brewing coffee according to claim 20, and further including a step of controlling a flow of said gases in said porous housing means, said controlling including at least one of controlling bubble size of said gases and a direction of flow of said gases within said porous housing means, thereby to utilize said gases to effectively agitate and promote an intermixing of said liquid with said coffee.

* * * * *